US006789801B2

(12) United States Patent
Snow

(10) Patent No.: US 6,789,801 B2
(45) Date of Patent: Sep. 14, 2004

(54) BACCARAT SIDE WAGER GAME

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 10/310,616

(22) Filed: Dec. 4, 2002

(65) Prior Publication Data

US 2004/0108656 A1 Jun. 10, 2004

(51) Int. Cl.[7] ..... A63F 1/00

(52) U.S. Cl. ..... 273/292; 273/146; 273/274; 273/309

(58) Field of Search ..... 273/292, 274, 273/146, 309

(56) References Cited

U.S. PATENT DOCUMENTS 5,362,064 A * 11/1994 Lofink et al. ..... 273/292
5,513,850 A * 5/1996 Vancura ..... 273/274
5,529,309 A * 6/1996 Bartlett ..... 273/292
5,673,917 A 10/1997 Vancura
5,794,964 A 8/1998 Jones et al.
5,806,854 A * 9/1998 Coleman et al. ..... 273/292
5,857,678 A * 1/1999 Coleman et al. ..... 273/292
6,179,291 B1 * 1/2001 Vancura ..... 273/292
6,227,969 B1 * 5/2001 Yoseloff ..... 463/13
6,279,910 B1 * 8/2001 de Keller ..... 273/292
6,293,864 B1 * 9/2001 Romero ..... 463/12
6,296,251 B1 * 10/2001 Webb ..... 273/292
6,299,531 B1 * 10/2001 Bommarito ..... 463/12
6,345,824 B1 * 2/2002 Selitzky ..... 273/292
6,390,474 B1 * 5/2002 Terminel et al. ..... 273/292

OTHER PUBLICATIONS

Scarne's Encycolpedia of Card Games by John Scarne, Copyright © 1973, 1983, pp. 292–304, "Chemin De Fer" (Baccarat).

* cited by examiner

*Primary Examiner*—Derris H. Banks
*Assistant Examiner*—Dolores R. Collins
(74) *Attorney, Agent, or Firm*—Mark A. Litman & Associates, P.A.

(57) ABSTRACT

A casino game is provided that can be played on a gaming table with a base game wager and an optional side bet bonus wager. The game is preferably a Baccarat derivative or Mini-Baccarat derivative, wherein there is at least one potential payout on the side bet bonus wager in addition to normal play of the game. One payoff for wagering on a winning hand in the side bet bonus wager (either the player's hand or a banker's hand) is based upon the hand that is wagered upon having a natural (two-card) 8-count or 9-count. A second potential payout on the side bet bonus wager is based upon the size of the difference between player hand point count and dealer hand point counts. Alternatively, the bonus hand pays only for the highest payout.

36 Claims, 2 Drawing Sheets

TIE
9 FOR 1
TIE
9 FOR 1
1
2
3
4
5
6
7
8
9
10
11
12
14
15
A
Y
E
R
S
P
L
2
4
6
8
10
12
14
2
4
6
8
10
12
14
14
12
10
8
6
4
2
2
4
6
8
10
12
14
14
12
10
8
6
4
2
14
12
10
8
6
4
2
14
12
10
8
6
4
2

BACCARAT SIDE WAGER GAME

BACKGROUND OF THE INVENTION

1. Field of the Invention

The present invention relates to card games and, more particularly, to a card game with a side bet bonus event, and the ability to wager on either a banker's hand or the player's hand.

2. Background of the Art

With the expansion of gaming and the increase in competition, it has become desirable in the industry to offer players a wide range of games and to add excitement to older games. Growth in slot machine popularity and the increase in the number of available specialty games have resulted in the overall reduction in play of conventional games, especially more standard games such as baccarat.

There has been constant pressure in the casino industry to remove less profitable live table games and use the floor space to install more profitable slot and video game machines. On the other hand, it is generally believed by casino operators to be undesirable to reduce the number of live gaming tables because of the inherent game attractiveness to both table players and casinos, and the fact that the presence of additional varieties of games may retain marginal business or provide sufficient alternative forms of play to customers so as to attract repeat, high stakes players. It is well known that gamblers who place the largest stake bets prefer to play live table games.

The game of Baccarat is based on simple concepts and procedures that are readily understood by both casual and regular players. Moreover, the game requires relatively low overhead to facilitate and monitor each game. In addition, floor space is limited in a casino, and casino operators are reluctant to replace an income-generating Baccarat game table with a totally new and unproven game variety.

In conventional Baccarat or min-baccarat, the rules for when a player and the banker must take a hit are generally well established. The only decision to be made by the player is whether to bet on the player or banker hand. In contrast, with the game of 21, experienced players can utilize established strategies such as card counting to reduce the inherent house advantage. The ability to reduce the house advantage is not of concern for casino operators with respect to baccarat but is an issue with blackjack because there are more variables such as more hits, more wager increasing steps (double downs, splitting, etc.) that can be exercised in blackjack, as compared to the game of baccarat. More experienced or beginning players may be hesitant to play Baccarat because it appears to be such a simple game and that there is little excitement and no chance for a significant payout on a hand without a large wager being placed. Novice players may play blackjack poorly even with some knowledge of the basic strategy and therefore have a more negative experience than might otherwise have been the case, and deterring them from longer play at the table. Although card counting is discouraged in most casinos, it is difficult to police card counting. A rehearsed card counter can typically count cards without exhibiting any outward appearance of counting. It would be desirable to provide a side bet game that is not as readily influenced by the ability of players to count cards.

In an attempt to accommodate the desire for variety and the retention of a significant table game presence, several Blackjack variant games and baccarat variant games have been introduced. These games include Mini-Baccarat, progressive win side bets in Baccarat, Multiple Action Blackjack, Spanish 21, Over and Under 13, Face-Up 21, and Royal Match. See, e.g., U.S. Pat. No. 5,673,917 to Vancura. A summary of known Blackjack variants is discussed in the Vancura patent.

The addition of side bet wagers to table games has provided an additional level of excitement and a chance for increased awards to be made in table games. The side bet in Over and Under 13 is limited to a one-to-one payout, so again, large payouts are provided with only large wagers. Such games as Minnesota 21™ provide higher bonuses (e.g., as much as $500 on a one dollar side bet for three consecutive blackjacks) with a side bet or house take based on the level of the underlying wagers. Other payouts that are multiples of the house take are based on hands of 6-7-8, blackjacks in suit, and the like.

U.S. Pat. No. 6,296,251 describes a baccarat or blackjack game with a payout that is a multiple of the initial wager (there is no side bet or additional wager beyond the wager on the underlying game). The broadest concept of the game described is as a method of playing a casino card game that is based on card hand numerical totals (e.g., blackjack and baccarat) and includes a player core wager, the core wager being the only wager required for the player to participate in the game. The method comprises establishing a dealer hand having a numerical total and a player hand having a numerical total; and paying a variable payoff according to the player core wager that varies according to an amount of numerical difference between the dealer hand numerical total and the player hand numerical total. A typical pay table for blackjack is described as

| Player Wins By | Payoff |
|---|---|
| 4 | 4 to 1 |
| 3 | 3 to 1 |
| 2 | 2 to 1 |
| 1 | 1 to 1 |

It is desirable to design and provide additional games, especially baccarat games, that provide good profits for the house and more betting opportunities, while providing players with more exciting play, more variety in play, and an opportunity to obtain greater payouts, especially payouts in excess of 5:1.

SUMMARY OF THE INVENTION

It is thus an aspect of the invention to provide a method and apparatus for playing a baccarat-type card game that overcomes some of the limitations associated with conventional casino baccarat games such as repetitiveness, lack of multiple odds, and the like. It is another aspect of the invention to provide a baccarat-type card game incorporating a variable payoff based a side wager as to either a natural count of 8 or 9 being obtained on the first two cards or the magnitude of the difference between a player's hand point count and a dealer's hand point count., The player may place a side bet on the player's hand or the dealer's hand. The hand that was bet on must be higher in rank than the hand that was not bet on by the player in order for the player to qualify to receive a payout on the side bet.

According to the invention, a casino game is provided that can be played on existing baccarat tables with minor side bet placement identification markings on the layout and different printed rules. The game according to the invention is a Baccarat derivative or Mini-Baccarat derivative, wherein there are two potential payouts in addition to normal play of the game. One payoff for wagering on a winning hand (either the player's hand or a banker's hand) is based upon the hand that is wagered upon having a natural (two-card) 8-count or 9-count. A second payout is based upon the size of the difference between player hand point count and dealer hand point counts, with the hand that the player has bet on being higher in rank than the other hand. For example, the player could win the side bet by placing a bet on the dealer hand, and the dealer hand beating the "player" hand by a predetermined minimum point difference.

DETAILED DESCRIPTION OF THE INVENTION

There are a number of variations of the basic game of baccarat, and the game is sometimes referred to in its various forms as Baccarat-Chemin-de-Fer, *Baccarat a deux tableaux*, Mini-Baccarat, and the like. The rules may vary slightly, and rules may vary from casino to casino, but the underlying game is the same. The underlying game is a competition between the hands of two players, usually referred to as the banker and the player. All players at the table can place wagers, but only one player participates in the game by receiving a hand of cards. Initially, two cards are dealt to each of the participating player and the banker. Each initial or partial two-card hand is reviewed by the banker and the player. The results of the competition are determined by how close the point total (explained in detail later) is to a value of nine. Two card hands with a point total of 8 or 9 are naturals. Point totals are based on the added face value of the cards, with the values of the cards being Ace=1, 2=2, 3=3, 4=4, 5=5, 6=6, 7=7, 8=8, 9=9, 10=0, Jack=0, Queen=0, and King=0. Only the last digit of the sum of the point values of the cards is operative in the play of the game. For example, a total value of the cards (both with the original hand or partial hand) would be read as 10=0, 11=1, 12=2, 13=3, 14=4, 15=5, 16=6, 17=7, 18=8, 19=9, 20=0, etc. A player is usually option on playing (wagering on) either the player's hand or the banker's hand. This is accomplished by placing the wager in a designated space for a wager on the banker's hand or the player's hand. A commission is usually extracted from the winning bets on the banker's hand (e.g., 5% of the winning bet on the banker's hand), because the banker usually wins more often than the player. No commissions are paid to the house when the player bets on the player hand. There may also be a separate wager placed on the occurrence that the banker's hand and the player's hand will tie. Depending on the odds provided by the house (usually from 8:1, 9:1 or 10:1), the house advantage is between 4.5% and 15%.

Figure 1:
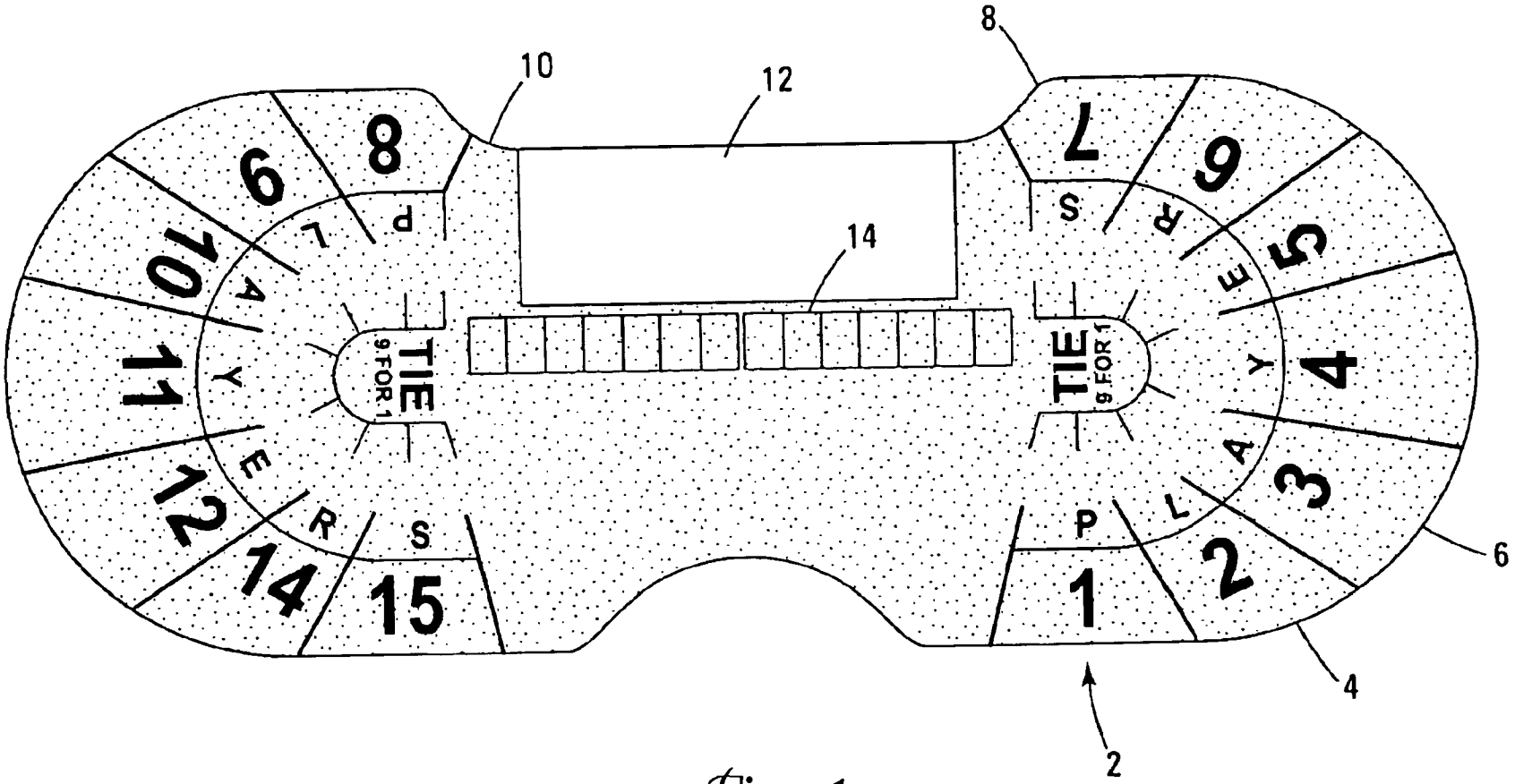
FIG. 1 shows a basic table format for a standard baccarat-type game.

A typical standard baccarat-type wagering game table 2 is shown in FIG. 1. The game table 2 has 15 player positions 4 numbered 1–15. There is a distinct area 6 labeled P-L-A-Y-E-R-S for placement at each player location for placement of the wager on the Player's hand. Adjacent to the Player's wager area 6 is an area 8 labeled as B-A-N-K-E-R-S for placement of the individual Player's wagers on the Banker's hand. Each player may place a bet or bets, even if that player is not participating by receiving cards. Further interior on the table 2 is a series of spaces 8 numbered 1, 2, 3, 4, 5, 6, 7 and spaces 10 numbered 8, 9, 10, 11, 12, 13, 14 and 15 (one space for each Player again) for placement of the tie wager.

Play is usually begun by having the dealer shoe (of multiple decks of shuffled cards) passed to a player (e.g., beginning with the player in seat number 1). The player in the dealing position must make at least a wager of the minimum table requirement. The bet must be directed to the player's hand or the banker's hand. Since the banker's hand has a higher likelihood of winning, the first player will usually wager on the banker's hand. The shoe is passed to the next player when the first dealer loses a hand or relinquishes the deal.

In traditional baccarat, only two hands are dealt in play. One hand is referred to as the banker's hand and the other hand is referred to as the player's hand. The first and third cards are dealt to the caller (a casino operator who calls the cards) and the second and fourth cards are dealt to the banker. All cards are dealt face down. The caller may slide the Banker's cards to a player (usually the player with the highest wager), although security concerns have limited this courtesy in card play. Both the player's hand and the banker's hand are then passed to the caller. He positions the hands in the appropriate positions and views the hands. If one hand is a natural (an original two card point count of 8 or 9) and the other hand is not, the hand that is a natural is a winning hand and the bets are paid off at odds of 1:1. A standard set of rules of play for the game with regard to play of the hand is:

| Player's 2-Card Hand | Action |
|---|---|
| 0 to 5 | Player may draw 1 card |
| 6 or higher | Player must stand |

When the player stands (does not draw), the rules for the banker are:

| Banker's 2-Card Hand | Action |
|---|---|
| 0 to 5 | Banker must draw 1 card |
| 6 or higher | Banker must stand |

When the player draws, the rules of play for the banker's hand are traditionally:

| Banker's 2-Card Hand | Action |
|---|---|
| 0 to 2 | Banker must draw 1 card |
| 3 or higher | Banker must stand |

It is to be noted that these are general and common rules that may be used for play of baccarat. The rules are subject to local variation and may be more variable based upon the odds that are provided in the play of the BIG BON US WIN side bet game of the present invention.

In the FIG. 1, the placement position 14 for placement of wager payouts for the player's that is positioned in front of the caller's position 12 may also be used for placement of the BIG WIN BONUS wager. The players may pass the wager to the caller/dealer, and the wagers on the bonus game placed before the deal of the game. Two additional rows of such betting positions (not shown) may be provided, one for making the BIG WIN BONUS wager on the banker's hand and the other for placement of the BIG WIN BONUS WAGER on the player's hand. Although it is more typical for the player to bet on the dealer or player hand for both the primary base game bet and the bonus bet, according to one example of the game, the player may place the primary bet on either hand, and may place the bonus bet on either hand. For example, the player may choose to play the banker's hand on the base game and the player's hand on the bonus game. Before the beginning of play, both the player's underlying game wager is made on the player's hand wager positions 4 and the banker's hand positions 6, and in the player of BIG WIN BONUS, when all players have been given the option to place the bonus wager.

Figure 2:
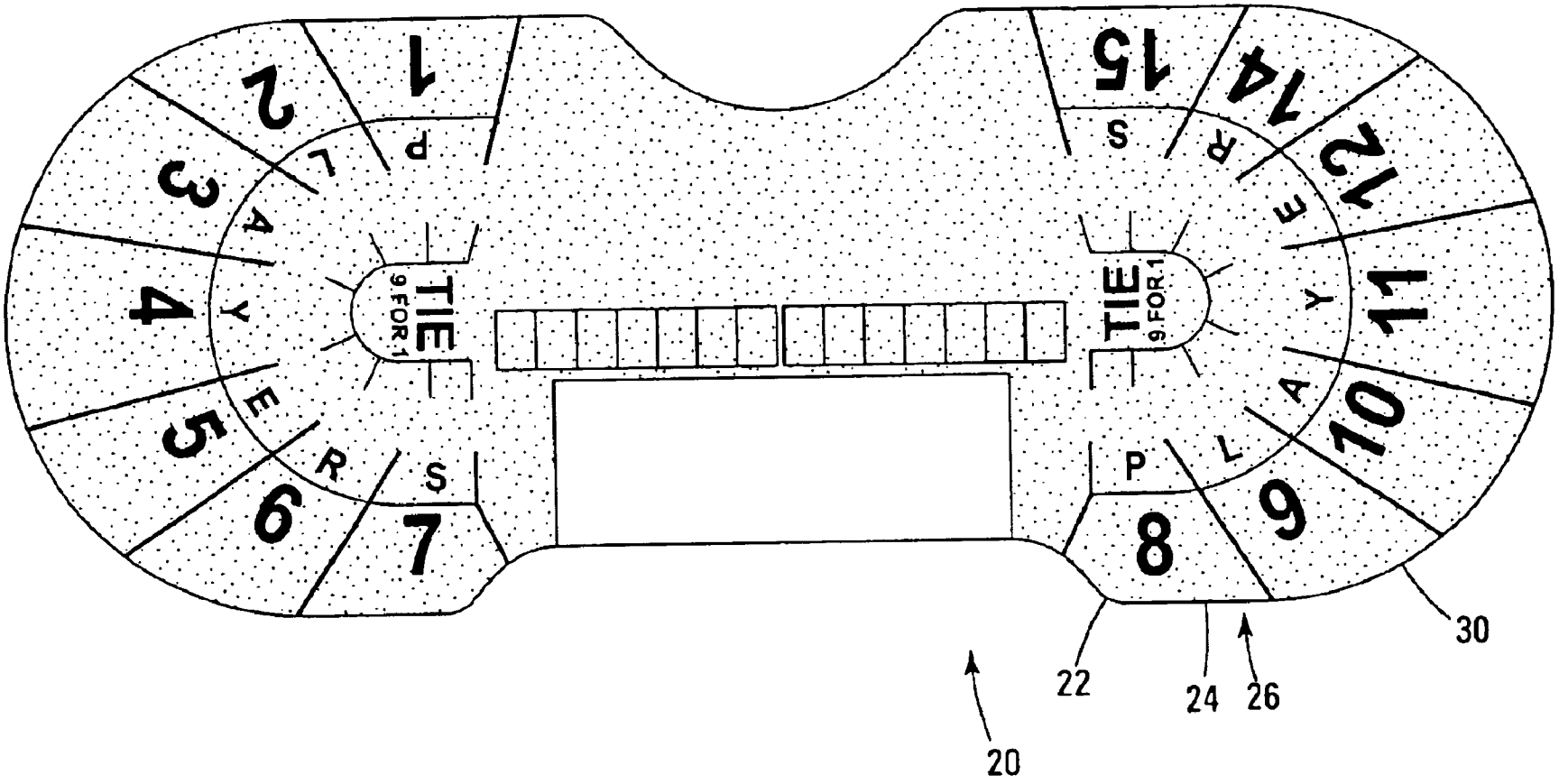
FIG. 2 shows a basic table format for a baccarat-type game with BIG BONUS WIN wagering side bet available.

In FIG. 2, each player position 26 on the table 20 is provided with two distinct wagering areas 22 and 24. These wagering positions may represent separate wagering areas 22 and 24 that may be bet placement area that are marked, for example, by printing on the table 20 top 30 to mark area 22 as a banker's hand BIG WIN BONUS wager and area 24 as a player's hand BIG WIN BONUS wager. Alternatively, two bet accepting structures (e.g., proximity detectors, slots, sensors, etc.) may be provided at each player's position 24 on the table 20 top 30 to provide area 22 as a banker's hand BIG WIN BONUS wager and area 24 as a player's hand BIG WIN BONUS wager.

Although the side bet game of the present invention can be played in conjunction with traditional baccarat, in another example of the invention, the side bet is offered with the game of mini baccarat. The rules of mini baccarat are essentially the same, except that each player receives a hand of cards. Each player is free to bet on the player hand or the dealer hand, as in traditional baccarat. If the player makes a side bet, the hand upon which the side bet is placed must rank higher than the other hand in order to qualify for a payout in the bonus game. Although the hitting schedule may not be identical to that of traditional baccarat, the basic game is essentially the same, with the object of the game being to bet on the hand that achieves a point value closest to 9. In order to win the side bet, the player must have made the side bet wager on a hand that is either a natural (a two card 8 or 9) or beats the competing hand by a minimum predetermined point spread, such as 5, 6 or 7 points (5 is preferred), for example. The basic baccarat-type game including the BIG WIN BONUS event may be generally described as a method of playing a wagering baccarat-type card game comprising both an underlying (preferably a baccarat-type) card game and an auxiliary card game. The play of the game generally comprises placing at least one first wager on the underlying card game. In alternate embodiments, the house rules may allow the player to participate in either the base game, the auxiliary game or both the base game and the auxiliary game. The first wager may be placed on a player's hand or on a banker's hand. In one preferred form of the invention, the player has an option of placing a second, side bet wager on the auxiliary card game. This second, side bet wager may be independently placed on the player hand or the banker hand. According to the invention, the player has the option to: a) place both bets on the player hand; b) place both bets on the banker hand; c) place a base bet on the banker hand and the auxiliary bet on the player hand; or d) place a base bet on the player hand and the auxiliary bet on the banker hand. In a preferred form of play, after placement of at least the first wager (and after any optional, second wager) the player is dealt a first number of cards (preferably one or usually two cards). At about the same time, the banker (sometimes referred to as a dealer) is usually dealt the same number of cards as was dealt to the player. The initial hand of cards need not be limited to two cards, but this is a preferred form of play. The base game also need not be limited to a game in which the point value of each card is summed in the base game. For example, the underlying game could be a three card poker game against a dealer hand, in which the point total of the hand in only the auxiliary game is summed to determine whether a bonus payout has been won. The rules of the game may or may not allow the player to draw additional cards. For example, if the base game is three card poker, each player and dealer each receive three cards. The base game is resolved using a known hierarchy of three card poker rankings, and then the point values of those assigned in baccarat or blackjack are used to determine whether the player has won the side bet. Necessarily the selected minimum winning point spread may be different than the five point minimum preferred in the game of baccarat. According to this form of the game, the player still has an option of playing either the player or dealer base game hand, and playing (or not playing) the optional side bet on either the player or dealer hand.

After the player views that player's cards, the player evaluates a point count in the player's hand. If the player has wagered on the player's hand and there is a natural (a count of 8 or 9 with the first two cards), the player will have won part of the bonus event. The player continues the game by a) accepting a card or b) declining a card and staying with the original point count. If house rules dictate when the player must take a hit, the player must abide by those rules. The banker's cards are then exposed, the banker takes or declines cards based upon the rules of the game. As noted-above, these rules may vary among casinos and may vary according to the play of the bonus game of the invention. Resolution of the first wager is made. If the player has wagered on the player hand, the player wins if the point count of the player's hand exceeds the point count of the banker's hand, with a maximum point count of 9 being possible according to the rules of the game. Typically the house pays 3:2 on a 8 or 9 point natural, and 1:1 when the player has bet on the hand that beats the other hand in point count. After resolution or at least determination of the results of the first wager, the player's hand and the banker's hand are compared to determine if the player has qualified to win a bonus payout amount. Resolution of the bonus wager according to the rules of the bonus event may be selected from the group consisting of:

a) when the wager was made on the banker's hand or the player's hand (designating that hand as the 'wagered hand');

b) providing and award on the side bet wager when the wagered hand is a natural (when a 2 card hand has a point total of 8 or 9); and c) providing an award on the side bet wager when the wagered hand exceeds the other hand by a minimum of 5 points.

The rules of the game may provide for paying an award for b or c in the alternative, or both b and c with the same hand. For example, if the player has a 9 point natural, and has placed both the basic bet and the side bet on the player hand, and the banker has a point count of 3, the house rules may provide a payout for the base game of 1:1, plus a payout on the bonus bet for the natural, the 6 point spread or both. Although in the play of conventional baccarat, only one player hand is dealt, in mini baccarat, all players receive a separate hand of cards in each round of play. The side bet method of the present invention is also suitable for playing in conjunction with the game of mini baccarat. The introduction of a variable payoff scale would have a dramatic impact on best basic player strategy if there were not conventional rules applied to the play of the game with regard to required hits or required stands. The optional hits may be converted to required hits in the rules described above to assure that play in the underlying game is not affected by the additional wager. This would prevent one player at the table controlling hits that would be favorable to that player's wager, yet would be antagonistic to the strategy for the wager of another player. As the player only receives 1:1 payout on the underlying game, and basic strategy usually holds that a player should stay with a count of 5 or 6, there is an incentive for the player to hit hands to increase the possible difference between the winning hand wagered upon (the player's hand or banker's hand) and the other hand (the banker's hand or the player's hand, respectively). This contrasts with the ordinary play of baccarat where standing or hitting such hands is influenced by reference to the card counting or staying with "the book" bet of hitting with hands below 5 or 6 and staying with hands of at least 5 or 6. Moreover, because of the variable payoff scale, a higher or lower player hand has more value, compounding the attraction of not standing on 5 or 6, or if the banker's hand has been wagered on, taking a hit when the player's hand has a good point count.

By creating a payoff scale that justifies a somewhat similar strategy of play to conventional baccarat, the game according to the present invention is simple to learn. The rule is that it is the player's goal to achieve a total single digit point count that is higher than the banker's hand single digit point count. If the player has bet on the higher ranking hand, he or she is typically paid 1:1 on the base game bet. With the simpler strategy according to the invention, the conventional Blackjack skill elements are reduced, and the casino has less need to be concerned about card counters. Moreover, new players and novice players have an easier learning curve along with a common desire to achieve a maximum hand total.

The house advantage can be varied by altering the payoff scale in the rules of play. Players typically better enjoy such a game with liberal options such as splitting pairs, no limits on re-splitting pairs, doubling any hand (including splits and soft totals), hitting after doubling, doubling after doubling, additional bonuses for specific hands (such as blackjack, pairs), etc. Still further, the game according to the invention can be played with alternative dealer standing rules, contrary to conventional Blackjack where the dealer must stand with 17 (except soft 17 at some casinos). If a dealer stands with 18, then the payoff scale could be raised, whereas if the dealer stands with 16, the payoff scale can be reduced.

The addition of an odds-based payoff scale to essentially an even money game therefore changes the whole dynamics of the game. Other casino games that rely on numerical values such as War can easily be adapted according to the invention with the introduction of the payoff scale, with payoffs depending upon the amount by which a hand is won. As with Baccarat, the exact rules of play for the game variant should or could be changed to most easily accommodate the payoff scale introduction.

Similarly, the bonus game could be scored using numerical values, while the base game is scored utilizing other scoring rules, such as the rules of poker.

These and other objects and advantages of the invention are achieved by providing a method of playing a card game including the steps of (a) receiving a core base wager from a player; (b) dealing hands of cards to a player and a dealer; (c) determining an outcome of the card game according to rules of the card game; (d) determining the point value of the player and dealer hands in the base game and (e) whether or not the player wins the card game according to the rules of the base card game, paying the player a payoff based on the BIG WIN BONUS wager determined by a numerical difference between the player's hand and the banker's hand.

Step (b) may be practiced by dealing initial or partial two-card Baccarat hands of cards to the player and the dealer, and step (c) may be practiced according to the rules of Baccarat or Mini-Baccarat. In this context, step (c) is preferably practiced by (c1) the player determining a numerical total of the player's hand; (c2) the player effecting one or more game options according to the rules of Baccarat (c3) the dealer determining a numerical total of the dealer's hand. Still further, the payout on the underlying baccarat game may be practiced by declaring the wager a push if the player hand numerical total is equal to the dealer hand numerical total. In the event of a push, the difference between the player's hand count and the dealer's hand count would always be below the minimum difference for the BIG WIN BONUS, although a wager on that bonus may still be paid based on the occurrence of a natural hand. The house would pay the player a variable payoff based on the BIG WIN BONUS wager according to the numerical difference between the player's hand and the dealer's hand if the player hand numerical total exceeds the banker hand numerical total or the banker hand numerical total exceeds the player hand numerical total by the minimum amount. The player forfeits the BIG WIN BONUS wager if the dealer hand numerical total exceeds the player hand numerical total. In one form of the invention, if the hand the player placed the bonus wager on is a natural, the player is paid for achieving that outcome, but not paid additionally for obtaining a point spread below the minimum. In another form of the invention, it is possible for the player to win a bonus payout for obtaining a natural and an additional bonus payout for achieving a high ranking hand with a point spread at or above stated minimum.

In one example of the invention, the variable payoff is determined according to the following schedule:

| Outcome | Player | Banker |
|---|---|---|
| Win by 9 Points | 30:1 | 30:1 |
| Win by 8 Points | 10:1 | 15:1 |
| Win by 7 Points | 9:1 | 9:1 |
| Win by 6 Points | 4:1 | 6:1 |
| Win by 5 Points | 1:1 | 1:1 |
| Natural Winner | 1:1 | 1:1 |

In another example of the invention, the pay table is the same for the player hand and the banker hand. An exemplary pay table for one preferred embodiment is shown below:

| Outcome | Player or Banker |
|---|---|
| Win by 9 Points | 30:1 |
| Win by 8 Points | 10:1 |
| Win by 7 Points | 8:1 |
| Win by 6 Points | 5:1 |
| Win by 5 Points | 3:1 |
| Natural Winner | 1:1 |

The hit frequency is expected to be approximately 25.3% on the player hand and 24.3% on the Banker hand using the above pay table. The house edge is approximately 2.2% on the player hand and about 10.5% on the banker hand.

In one example, if the player were to bet on the player hand and received a 9 point natural, and the dealer hand was 3 points, the player wins 1:1 on the bonus bet and another 5:1 on the point spread. In another example of the invention, only the highest payout pays, and the player would win 5:1 only on the bonus bet.

The range of bonus payouts may be preferably within the range of:

| Outcome | Player | Banker |
|---|---|---|
| Win by 9 Points | 15:1–40:1 | 15:1–40:1 |
| Win by 8 Points | 6:1–15:1 | 6:1–18:1 |
| Win by 7 Points | 5:1–10:1 | 5:1–9:1 |
| Win by 6 Points | 2:1–5:1 | 2:1–7:1 |
| Win by 5 Points | 1:1–3:1 | 1:1–3:1 |
| Natural Winner | 1:1–2:1 | 1:1–2:1 |

In alternative variations, the base game may be practiced according to the rules of War, blackjack, three card poker, five card poker, seven card poker or other known casino game. In those instances, the specific point spread and associated payout odds would necessarily vary, and would be determined by the game mathematics. For example, for purposes of evaluating the bonus game, all face cards and ten cards in the hand could be assigned a value of zero or 10, regardless of the rules of the underlying game.

In accordance with another aspect of the invention, there is provided a method of playing a casino card game that is capable of being evaluated on card hand numerical totals for the purpose of scoring the auxiliary game and includes a player base game wager and the bonus game wager. The method includes paying a variable payoff according to the player bonus wager based on a difference between a dealer hand numerical total and a player hand numerical total. The base game may pay odds, or may pay variable odds, depending upon the rules of the game. The variable payoff is preferably determined according to a predetermined payout schedule.

Although in a preferred method of the invention the player receives a bonus only when the hand that he or she wagered on is higher in point value than the opposing hand, the house rules could provide that the player be paid a payout for absolute point spreads between the player and banker (or dealer) hands, regardless of the selection of hands. In other words, the player could place a side bet on the occurrence of a point spread of five or more points, regardless of which hand is higher. This rule variation would necessarily require a modification of (a lowering of at least some) payout odds for the various point spread combinations, as the combinations would occur more frequently under this set of game rules.

In accordance with still another aspect of the invention, there is provided an apparatus (e.g., video game or network system) configured for playing a card game including a display, a player interface for receiving player input, and a processor configured to effect game play, the processor enabling the method according to the invention. In accordance with yet another aspect of the invention, there is provided an apparatus configured for playing a card game having a display, a player interface, and a controller receiving input from the player interface, the controller including circuitry for effecting game play and including structure for receiving a base game wager from a player and the optional BIG WIN BONUS wager and for dealing hands of cards to a player and a dealer, and a processing circuit operatively coupled with the receiving and dealing structure. The processing circuit determines an outcome of the base card game and if necessary, separately calculates separate numerical values of the base game hands to score the bonus wager. In one preferred form of the invention, the numerical hand values are used to determine the outcome in the base game. If the player wins the card game according to the rules of the base card game or based on the BIG WIN BONUS wager, the player is paid a payoff based on the base game wager and then a bonus payout determined by a numerical difference (or point spread) between the player's hand and the banker's hand.

According to still another aspect of the invention, there is provided an apparatus for playing a casino card game that is based on card hand numerical totals and includes a player base game wager and the BIG WIN BONUS wager. In one example of the invention, both bets are optional. In other forms of the invention, both bets are mandatory, the bonus bet is mandatory or just the base game bet is mandatory. The apparatus includes a display, a player interface, and a controller receiving input from the player interface. The controller includes circuitry for effecting game play and structure for paying a variable payoff according to the player base game wager and the bonus game wager based on a difference between a dealer hand numerical total and a player hand numerical total.

In the following detailed description, the method and apparatus according to the present invention will be described in conjunction with its application to a casino environment, thus incorporating wagers, payouts, etc. Those of ordinary skill in the art will readily comprehend alternative applications of the present invention outside a casino environment, and the invention is not meant to be limited to the described application. For example, the game may be embodied in a video game that is played for entertainment purposes against a computer or the like. Alternatively, players may play the game without wagers in a head-to-head format with one player acting as a dealer, with the players simply keeping track of wins and losses.

As with conventional Baccarat, the number of card decks used for the game according to the invention may be one or more. Each player places a base game baccarat wager in a respective betting area in order to participate in the game. In the context of the present invention, the base wager may be the only wager, or the game may be played with only the BIG WIN BONUS wager, both bets are required, or the BIG WIN BONUS is the only wager required for a player to participate in the game. It is possible for the game to be played with a wager on only the BIG WIN Bonus wager and with no underlying wager being placed on the baccarat-type game, but it is preferred that the underlying wager on the baccarat game must be placed to enter in the BIG WIN BONUS game.

After wagers are placed, each participating player receives two cards in rotation (one card at a time) or in sequence (two cards at a time) with the banker receiving two cards face down. The player then elects how to play the player hand according to the game rules, which may be printed on the table top (not shown). After all player actions are completed, the banker's hand is played according to the game rules, and all wagers are settled according to the payoff scales. In preferred forms, if the player wins the card game according to the rules, the player is paid a payoff based on the base game wager and then the BIG WIN BONUS wager/payout is determined by a numerical difference between the player's hand and the dealer's hand, depending upon which hand is wagered upon. For example, the player might receive a 1:1 payout for playing the banker hand, when the banker hand is a 6 and the player hand is a 4. The player would not receive a payout on the bonus hand because the minimum point spread to obtain a payout when the bet upon hand is not a natural is 5. Since the player did not obtain a natural or beat the opposing hand by 5 points or more, no payout is awarded.

Thus according to the present invention, there is a fixed bonus payoff for a natural in addition to any payoff on the underlying game wager and a variable payoff paid according to the player's side bet wager based on a difference between the hand numerical total bet on by the player to participate in the bonus game and the numerical total of the opposing hand. As the player may make the bonus bet on either the player or banker hand, the bonus point spreads are evaluated on the basis of a) point totals, and b) whether the player bet on the higher ranking hand. As noted above, this methodology effects greater enjoyment for players with the possibility of higher payoffs than in conventional Baccarat and also enables novice and inexperienced players to play the underlying game with fixed rules.

Although described in the context of a Baccarat derivative, the principles according to the present invention wherein a variable payoff is paid based on a difference between a dealer hand numerical total and a player hand numerical total, can be applied to War, blackjack, three card poker and other conventional casino games wherein the numerical total of base game hands can be totaled according to certain predetermined rules. The pay table (with various point spreads and assigned payout odds) would be varied according to the points available or counted in the outcome of the base game.

As would be apparent to those skilled in the relevant art, the invention can be embodied in a wide variety and forms of media, but not limited to, single player slot video machines, multi-player slot video machines, electronic games and devices, lottery terminals, scratch-card formats, software as well as in-flight, home and Internet entertainment. In addition, the invention can be readily implemented as a computer program product (e.g., floppy disk, compact disc (CD), etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

While the invention has been described in connection with what is presently considered to be the most practical and preferred embodiments, it is to be understood that the invention is not to be limited to the disclosed embodiments. Variations in the construction of the table, software, hardware, gaming apparatus box design and the like are considered to be within the skill of the ordinary artisan and are contemplated in the scope of the invention. The claims are intended to cover various modifications and equivalent arrangements included within the spirit and scope of the appended claims.

What is claimed:

1. A method of playing a wagering game comprising:

a) a player selecting one of a player hand and a house hand and placing a base game bet on the selected hand to participate in a base game;

b) a player selecting one of a player hand and a house hand and placing a bonus game bet on the selected hand to participate in a bonus game;

c) a dealer dealing at least one player hand and the house hand according to a first set of game rules;

c) resolving the base card game according to the first set of game rules;

d) assigning a point value to both the player hand and the dealer hand according to a second set of game rules; and e) awarding the player a bonus payout when the selected bonus game hand has a point value that exceeds a point value of the other hand by a predetermined amount.

2. The method of claim 1, wherein the first set of game rules is selected from the group consisting of baccarat, mini baccarat, war, three card poker and blackjack.

3. The method of claim 1, wherein the first set of game rules comprises baccarat.

4. The method of claim 1, wherein the second set of game rules comprises baccarat.

5. The method of claim 1, wherein the first set of game rules and the second set of game rules are the same.

6. The method of claim 1, wherein the base game bet is mandatory.

7. The method of claim 1, wherein the base game bet is optional.

8. The method of claim 1, wherein the bonus game bet is mandatory.

9. The method of claim 1, wherein the bonus game bet is optional.

10. The method of claim 1, wherein the base and bonus games are resolved according to the rules of baccarat and the predetermined point value is at least 5 points.

11. The method of claim 1, wherein the base game is mini baccarat, and the bonus payouts are awarded according to the following schedule:

| Outcome | Player | Banker |
|---|---|---|
| Win by 9 Points | 30:1 | 30:1 |
| Win by 8 Points | 10:1 | 15:1 |
| Win by 7 Points | 9:1 | 9:1 |
| Win by 6 Points | 4:1 | 6:1 |
| Win by 5 Points | 1:1 | 1:1 |
| Natural Winner | 1:1 | 1:1. |

12. The method of claim 1, wherein the house hand is a banker's hand.

13. The method of claim 1, wherein the house hand is a dealer's hand.

14. The method of claim 1, wherein the base game is mini baccarat, and the bonus payouts are awarded according to the following schedule:

| Outcome | Player or Banker |
|---|---|
| Win by 9 Points | 30:1 |
| Win by 8 Points | 10:1 |
| Win by 7 Points | 8:1 |
| Win by 6 Points | 5:1 |
| Win by 5 Points | 3:1 |
| Natural Winner | 1:1. |

15. The method of claim 1 wherein resolution of the bonus game bet comprises payouts within the range of:

| Outcome | Player or Banker |
|---|---|
| Win by 9 Points | 15:1–40:1 |
| Win by 8 Points | 6:1–18:1 |
| Win by 7 Points | 5:1–9:1 |
| Win by 6 Points | 2:1–7:1 |
| Win by 5 Points | 1:1–3:1 |
| Natural Winner | 1:1–2:1. |

16. A method of playing a wagering game comprising:

a) a player having the option of placing a wager on either one of two hands, the two hands referred to as a player's hand and a banker's hand the player placing the wager on one of two hands, that one of two hands on which a wager is placed becoming the wagered hand;

c) an initial hand of at least one card being dealt as a player's hand and at least one card being dealt as the banker's hand;

d) evaluating the wagered hand to determine if a predetermined point total exists in the wagered hand to qualify for a payout;

e) if the player's hand is allowed or required to receive a card in addition to the initial at least one card, providing another card to the player's hand and totaling the player's point count to obtain a player's point count according to rules of the wagering game;

f) if the banker's hand is allowed or required to receive a card in addition to the initial at least one card, providing another card to the banker's hand and totaling the banker's point count to obtain a banker's point count according to rules of the wagering game;

g) comparing the difference in point counts between the wagered hand and the other of the two hands; and h) providing an award to the player placing the wager on the one of the two hands if the point count of the wagered hand is at least a predetermined number of total points higher than the point count of the other of the two hands.

17. The method of claim 16 wherein the wagering game comprises a baccarat-type wagering game.

18. The method of claim 17 wherein the award to the player increases as the point count of the wagered hand increases over the at least a predetermined number of total points higher than the point count of the other of the two hands.

19. The method of claim 18 wherein the predetermined number is at least 5.

20. The method of claim 16 wherein the award to the player increases as the point count of the wagered hand increases over the at least a predetermined number of total points higher than the point count of the other of the two hands.

21. The method of claim 20 wherein the predetermined number is at least 5.

22. A method of playing a wagering card game comprising both an underlying baccarat-type card game and an auxiliary bonus card game in which two competitive hands are dealt, the method comprising:

placing at least one first wager on the underlying baccarat-type card game;

optionally placing a second side bet wager on one hand between a player's hand and a dealer's hand in the auxiliary bonus card game;

dealing a first number of cards to a player as the player's hand;

dealing the same number of cards to a banker as a banker's hand;

after the player's hand is viewed, a point count in the player's hand is evaluated, the player accepting a card or declining a card according to rules of the wagering game;

a point count in the banker's hand is evaluated;

the banker's hand takes or declines cards according to the rules of the game;

an award to the player is evaluated on the basis of:

i) the rules of the underlying baccarat-type card game on the at least one first wager;

ii) a predetermined count occurring in the one hand between a player's hand and a dealer's hand in the auxiliary bonus card game; and iii) at least a predetermined point count difference existing between the one hand between a player's hand and a dealer's hand in the auxiliary bonus card game and the other of the two competitive hands.

23. The method of claim 22 wherein the predetermined point count in ii) is a point count of 8 or 9.

24. The method of claim 23 wherein the predetermined point count difference is at least 5 points between the point count totals of the at two competitive hands.

25. The method of claim 22 wherein the predetermined point count difference is at least 5 points between the point count totals of the at two competitive hands.

26. A method of playing a wagering baccarat-type game comprising:

a player placing a first wager on a player's hand or a banker's hand;

the player placing an optional side bet on a bonus event, the optional side bet being placed on the player's hand or the banker's hand;

dealing cards according to the rules of baccarat and resolving the first wager according to the rules of baccarat; and resolving the side bet according to:

a) the hand on which the side bet was placed being a count of eight or nine; and b) the hand on which the side bet was placed having a point count according to the rules of baccarat that is at least 5 points higher than a point count in the hand on which the side bet was not placed by the player.

27. The method of claim 26 wherein resolution of the side bet wager comprises paying the player an amount equal to the side bet wager when the hand on which a side bet was placed has a count in the first two cards is 8 or 9.

28. The method of claim 27 wherein resolution of the side bet wager comprises payouts within the range of:

| Outcome | Player | Banker |
|---|---|---|
| Win by 9 Points | 15:1–40:1 | 15:1–40:1 |
| Win by 8 Points | 6:1–15:1 | 6:1–18:1 |
| Win by 7 Points | 5:1–10:1 | 5:1–9:1 |
| Win by 6 Points | 2:1–5:1 | 2:1–7:1 |
| Win by 5 Points | 1:1–3:1 | 1:1–3:1 |
| Natural Winner | 1:1–2:1 | 1:1–2:1. |

29. The method of claim 26 wherein resolution of the side bet wager comprises payouts within the range of:

| Outcome | Player | Banker |
|---|---|---|
| Win by 9 Points | 15:1–40:1 | 15:1–40:1 |
| Win by 8 Points | 6:1–15:1 | 6:1–18:1 |
| Win by 7 Points | 5:1–10:1 | 5:1–9:1 |
| Win by 6 Points | 2:1–5:1 | 2:1–7:1 |
| Win by 5 Points | 1:1–3:1 | 1:1–3:1 |
| Natural Winner | 2:1–1:1 | 2:1–1:1. |

30. The method of claim 26 wherein resolution of the side bet wager comprises payouts within the range of:

| Outcome | Player | Banker |
|---|---|---|
| Win by 9 Points | 30:1 | 30:1 |
| Win by 8 Points | 10:1 | 15:1 |
| Win by 7 Points | 9:1 | 9:1 |
| Win by 6 Points | 4:1 | 6:1 |
| Win by 5 Points | 1:1 | 1:1 |
| Natural Winner | 1:1 | 1:1. |

31. The method of claim 26 wherein resolution of the side bet wager comprises payouts within the range of:

| Outcome | Player | Banker |
|---|---|---|
| Win by 9 Points | 30:1 | 30:1 |
| Win by 8 Points | 10:1 | 15:1 |
| Win by 7 Points | 9:1 | 9:1 |
| Win by 6 Points | 4:1 | 6:1 |
| Win by 5 Points | 1:1 | 1:1 |
| Natural Winner | 1:1 | 1:1. |

32. A method of playing a baccarat-type game comprising:

a player placing a wager on an underlying baccarat-type game;

the player having an option of placing a second wager on a bonus event, the second wager being placed on the player's hand or a banker's hand, the player's hand or banker's hand wagered upon becoming a wagered hand;

dealing at two cards to the player to form a player's hand and dealing at least two cards to the banker to form the banker's hand in the baccarat-type game;

playing the baccarat-type game to conclusion;

evaluating the wagered hand with respect the second wager on a bonus event according to:

a) whether a count of a specific predetermined set of point totals was dealt with a first two cards in the wagered hand and b) whether a predetermined difference in count between the wagered hand and the other of the player's hand and banker's hand was achieved at an end to the play of the baccarat-type game; and paying an award on the second wager on a bonus event when the specific predetermined set of point totals was received in the two cards forming the wagered hand and/or when the predetermined difference in count between the wagered hand and the other hand was achieved.

33. The method of claim 32 wherein resolution of the second wager comprises paying the player an amount equal to the second wager when the hand on which the second wager was placed has a count in the first two cards is 8 or 9.

34. The method of claim 32 wherein resolution of the side bet wager comprises payouts within the range of:

| Outcome | Player | Banker |
|---|---|---|
| Win by 9 Points | 15:1–40:1 | 15:1–40:1 |
| Win by 8 Points | 6:1–15:1 | 6:1–18:1 |
| Win by 7 Points | 5:1–10:1 | 5:1–9:1 |
| Win by 6 Points | 2:1 5:1 | 2:1 7:1 |
| Win by 5 Points | 1:1–3:1 | 1:1–3:1 |
| Natural Winner | 1:1–2:1 | 1:1–2:1. |

35. The method of claim 32 wherein resolution of the side bet wager comprises payouts within the range of:

| Outcome | Player | Banker |
|---|---|---|
| Win by 9 Points | 30:1 | 30:1 |
| Win by 8 Points | 10:1 | 15:1 |
| Win by 7 Points | 9:1 | 9:1 |
| Win by 6 Points | 4:1 | 6:1 |
| Win by 5 Points | 1:1 | 1:1 |
| Natural Winner | 1:1 | 1:1. |

36. A method of playing a wagering game comprising:

a) a player selecting one of a player hand and a house hand and placing a base game bet on the selected hand to participate in a base game, an other of the two hands being an unselected hand for wagering;

b) a player selecting one of a player hand and a house hand and placing a bonus game bet on the selected hand to participate in a bonus game;

c) a dealer dealing at least one player hand and the house hand according to a first set of game rules;

c) resolving the base card game according to the first set of game rules;

d) assigning a point value to both the player hand and the dealer hand according to a second set of game rules; and e) awarding the player a bonus payout when the selected bonus game hand has a point value that exceeds a point value of the other hand of the two hands in a) by a predetermined amount.

* * * * *